US006185385B1

(12) United States Patent
Mestha et al.

(10) Patent No.: US 6,185,385 B1
(45) **Date of Patent: *Feb. 6, 2001**

(54) APPARATUS AND METHOD FOR ONLINE ESTABLISHMENT OF PRINT CONTROL PARAMETERS

(75) Inventors: Lingappa K. Mestha, Fairport; Yao Rong Wang, Webster; John Buranicz, Rochester; Meera Sampath, Penfield; Mark A. Scheuer, Williamson, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/083,142

(22) Filed: May 22, 1998

(51) Int. Cl.[7] ..... G03G 15/00
(52) U.S. Cl. ..... 399/49; 399/46; 399/72
(58) Field of Search ..... 399/46, 48, 49, 399/72

(56) References Cited

U.S. PATENT DOCUMENTS

| | | | |
|---|---|---|---|
| 3,870,968 | | 3/1975 | Vosteen et al. . |
| 4,205,257 | | 5/1980 | Oguro et al. . |
| 4,403,866 | | 9/1983 | Falcoff et al. . |
| 4,724,461 | | 2/1988 | Rushing . |
| 4,853,639 | | 8/1989 | Vosteen et al. . |
| 4,887,217 | | 12/1989 | Sherman et al. . |
| 5,003,327 | | 3/1991 | Theodoulou et al. . |
| 5,045,882 | * | 9/1991 | Roehrs et al. ..... 399/72 |
| 5,243,383 | | 9/1993 | Parisi . |
| 5,481,380 | | 1/1996 | Bestmann . |
| 5,544,258 | | 8/1996 | Levien . |
| 5,559,173 | | 9/1996 | Campo et al. . |

(List continued on next page.)

FOREIGN PATENT DOCUMENTS 4-314768 11/1992 (JP) .

OTHER PUBLICATIONS

"Color Technology for Imaging Devices," Henry Kang, pp. 318–327.

"Miniature Lights for Miniature Spectrometers," Ocean Optics, Inc.

"Sequential Linear Interpolation of Multidimensional Functions," James Z. Chang et al., IEEE Transactions on Image Processing, vol. 6, No. 9, Sep. 1997.

*Primary Examiner*—William J. Royer
(74) *Attorney, Agent, or Firm*—Oliff & Berridge, PLC

(57) ABSTRACT

An online printing parameter establishment apparatus is used with a xerographic printing device for printing high quality prints given a target value. The xerographic printing device is capable of producing at least one print control patch on a photoreceptor and is capable of sensing a value of the at least one print control patch. The xerographic printing device has a plurality of sets of inherent performance characteristic values. The online printing parameter establishment apparatus includes a controller device and a switch device. The controller device is operative to produce a first database of different ones of the sensed values. Each sensed value is associated with a respective one of the plurality of sets of inherent performance characteristic values based upon the target value. The controller device is also operative to produce a second database of a plurality of control values. Each one of the control values is extracted from a respective one of the sensed values and the associated set of inherent performance characteristic values. Further, the controller device selects one of the control values which is closely comparable to the target value. A method for online establishment of print control parameters to render high quality prints using a xerographic printing process is also described.

35 Claims, 9 Drawing Sheets

U.S. PATENT DOCUMENTS

| | | | | |
|---|---|---|---|---|
| 5,662,044 | | 9/1997 | Loffler et al. . | |
| 5,664,072 | | 9/1997 | Ueda et al. . | |
| 5,708,916 | | 1/1998 | Mestha . | |
| 5,717,978 | | 2/1998 | Mestha . | |
| 5,734,407 | * | 3/1998 | Yamada et al. | 399/46 X |
| 5,748,221 | | 5/1998 | Castelli et al. . | |
| 5,749,019 | | 5/1998 | Mestha . | |
| 5,749,021 | | 5/1998 | Mestha . | |
| 5,754,918 | | 5/1998 | Mestha et al. . | |
| 5,812,903 | * | 9/1998 | Yamada et al. | 399/49 X |
| 5,822,079 | * | 10/1998 | Okuno et al. | 399/49 X |
| 5,884,118 | | 3/1999 | Mestha et al. . | |

* cited by examiner

APPARATUS AND METHOD FOR ONLINE ESTABLISHMENT OF PRINT CONTROL PARAMETERS

BACKGROUND OF THE INVENTION

1. Field of Invention

The invention is directed to online establishment of print control parameters to render high quality prints using a xerographic printing process. More particularly, the invention relates to an online printing parameter establishment apparatus and method for use with a xerographic printing device for printing high quality prints without first printing inferior quality prints.

2. Description of Related Art

The basic xerographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic printing machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the "inter-document space". After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface and a fully discharged portion of the photosensitive surface between the image areas.

The approach utilized for multicolor electrostatographic printing is substantially identical to the process described above. However, rather than forming a single latent image on the photosensitive surface in order to reproduce an original document, as in the case of black and white printing, multiple latent images corresponding to color separations are sequentially recorded on the photosensitive surface. Each single color electrostatic latent image is developed with toner of a color complementary thereto and the process is repeated for differently colored images with respective toner of complementary color. Thereafter, each single color toner image can be transferred to the copy sheet in superimposed registration with the prior toner image, creating a multi-layered toner image on the copy sheet. Finally, this multi-layered toner image is permanently affixed to the copy sheet in a conventional manner to form a finished color copy.

As described, the surface of the photoconductive member must be charged by a suitable device prior to exposing the photoconductive member to a light image. This operation is typically performed by a corona charging device. One type of a corona charging device comprises a current carrying electrode enclosed by a shield on three sides and a wire grid or control screen positioned thereover and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, i.e. the photoconductive member, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely, at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing jobs, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know the surface potential on the photoreceptor at each of the color developing areas in the developing zone, it would be necessary to locate a voltmeter at each color area within the developing zone.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage and a laser power for discharging the substrate. The parameters are various difference and ratio voltages.

A problem associated with conventional xerographic printing is that, each time a print job changes, the printer typically uses a new operating regime. When this occurs, degradation in print quality is expected. Thus, several prints of a degradated print quality must be made before the xerographic printing process can print high quality prints in the new operating regime.

Also, it is possible that the print quality might deviate during a printing job. It is thus possible to produce inferior quality prints during the same job interval.

It would be advantageous to provide an online printing parameter establishment apparatus for use with a xerographic printing device for printing high quality prints without printing any inferior quality prints when the operating regime is changed between print jobs. It would be desirable to provide an online printing parameter establishment apparatus that can also reestablish high quality prints during a print job if the print quality begins to deviate from the parameters established in the new operating regime.

SUMMARY OF THE INVENTION

An online printing parameter establishment apparatus is used with a xerographic printing device for printing high quality prints based upon a target value. The xerographic printing device is capable of producing at least one print control patch on a photoreceptor and is capable of sensing a value of the at least one print control patch. The xerographic printing device has a plurality of sets of inherent performance characteristic values. The online printing parameter establishment apparatus includes a controller device and a switch device. The controller device is operative to produce a first database of different ones of the sensed values. Each sensed value is associated with a respective one of the plurality of sets of inherent performance characteristic values based upon the target value. The controller device is also operative to produce a second database of a plurality of control values. Each one of the control values is extracted from a respective one of the sensed values and the associated set of inherent performance characteristic values. Further, the controller device selects one of the control values with the associated set of inherent performance characteristic values. The selected control value is comparable to the target value.

The switch device is operably connected to the controller device. The switch device is operative to move between an establishment parameter state and a print production state. When the switch device is in the established parameter state, the controller device produces the first and second databases and selects the one control value with the associated set of inherent performance characteristic values while the xerographic printing device is incapable of printing prints. When the switch device is in the print production state, the controller device provides the one control value with the associated set of inherent performance characteristic values to the xerographic printing device so that the xerographic printing device can print high quality prints without printing inferior quality prints.

A method of practicing the online print parameter establishment apparatus of the invention is also described. The method stops the printing of the xerographic printing process and then produces at least one print control patch on a photoreceptor which is based upon a target value and a selected set of a plurality of sets of inherent performance characteristic values. A sensed value associated with the selected set of the inherent performance characteristic values is read and stored. The producing, reading, and storing steps are repeated using another one of the plurality of sets of the inherent performance characteristic values until each set of the inherent performance characteristic values is associated with each stored sensed value. Then, a control value is extracted for each one of the sets of inherent performance characteristic values and the associated sensed value. The control value which is associated with a particular set of the inherent performance characteristic values and the associated sensed value is stored. The most current appropriate set of inherent performance characteristic values and the associated control value that is associated most closely with the target value is provided to the xerographic printing process. Using the appropriate set of inherent performance characteristic values and the associated control value, the xerographic printing process prints high quality prints without having to print inferior quality prints.

DETAILED DESCRIPTION OF PREFERRED EMBODIMENTS

Figure 1:
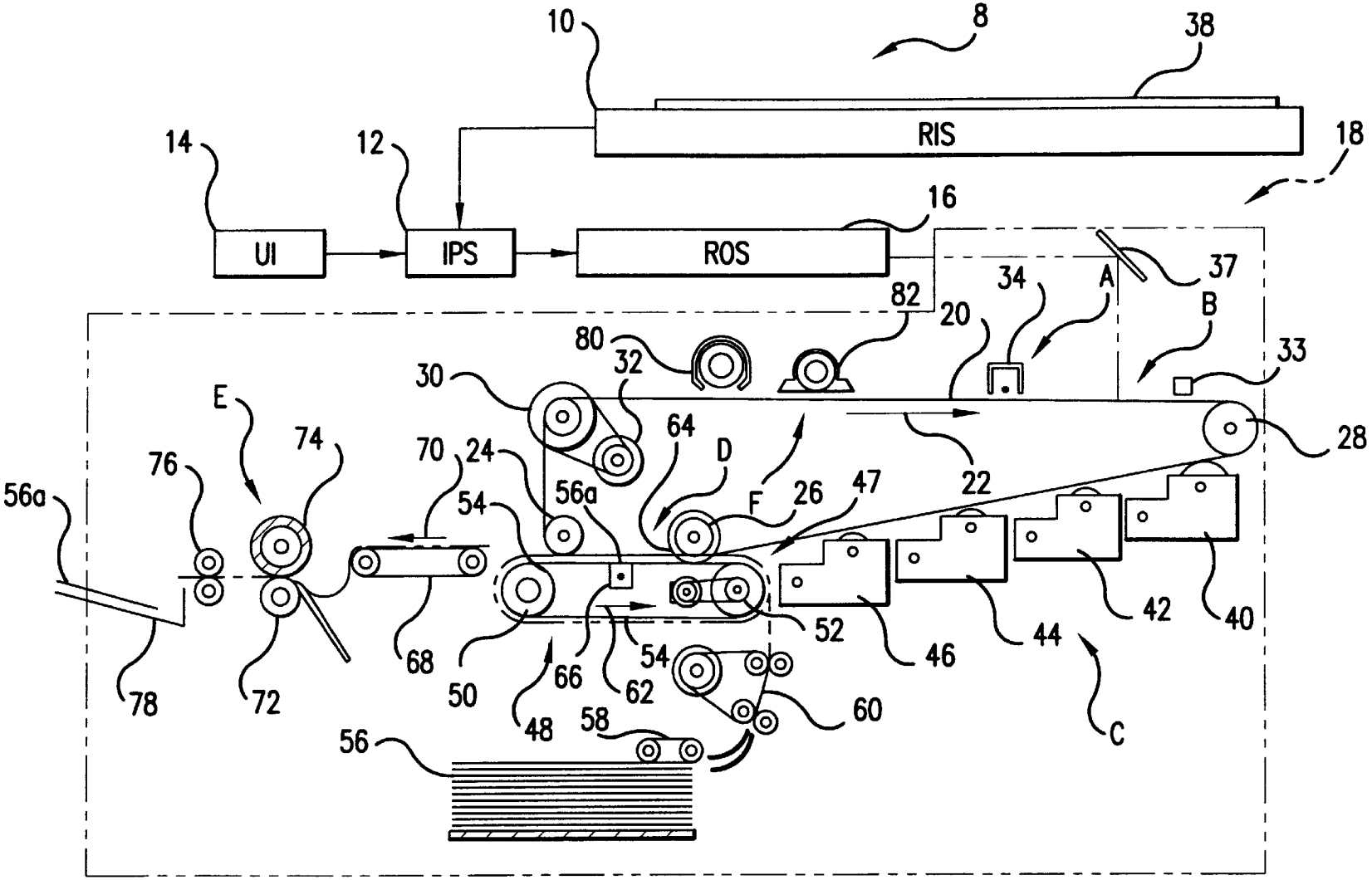
FIG. 1 PRIOR ART
FIG. 1 is a schematic diagram of a conventional xerographic printing device.

For a general understanding of the features of the invention, reference is made to the drawings wherein like references have been used throughout to designate identical elements. A schematic diagram showing a conventional xerographic printing device 8 capable of performing a xerographic printing process is shown in FIG. 1. It would become evident from the following discussion that the invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

With reference to FIG. 1, before describing the particular features of the invention in detail, the conventional xerographic printing device 8 will be described. The xerographic printing device 8 may be a multicolor copier, as for example, the recently introduced Xerox Corporation "5775" copier. To initiate the copying or xerographic process, a multicolor original document 38 is positioned on a raster input scanner RIS 10. The RIS 10 contains document illumination lamps, optics, a mechanical scanning drive, and a charge coupled device (CCD array) for capturing the entire image from the original document 38. The RIS 10 converts the image to a series of raster scan lines and measures a set of primary color densities, i.e. red, green and blue densities, at each point of the original document. This information is transmitted as an electrical signal to an image processing system IPS 12 which converts the set of red, green and blue density signals to a set of calorimetric coordinates. The IPS 12 contains control electronics for preparing and managing the image data flow to a raster output scanner ROS 16.

A user interface UI 14 is provided for communicating with the IPS 12. The UI 14 enables an operator to control the various operator adjustable functions whereby the operator actuates the appropriate input keys of the UI 14 to adjust the parameters of the copy. The UI 14 may be a touch screen, or any other suitable device for providing an operator interface with the xerographic system. The output signal from the UI 14 is transmitted to the IPS 12 which then transmits signals corresponding to the desired image to the ROS 16.

The ROS 16 includes a laser with rotating polygon mirror blocks. The ROS 16 eliminates, via a multi-facet polygonal mirror 37, a charged portion of a photoreceptor belt 20 of a printer or marking engine 18. Preferably, the mirror 37 is used to illuminate the photoreceptor belt 20 at a rate of about 400 pixels per inch. The ROS 16 exposes the photoreceptor belt 20 to record a set of three subtractive primary latent images thereon corresponding to the signals transmitted from the IPS 12. One latent image is to be developed with cyan developer material, another latent image is to be developed with magenta developer material and the third latent image is to be developed with yellow developer material. These developed images are subsequently transferred to a copy sheet or print 56*a* or 56*a'* in superimposed registration with one another to form a multicolored image on the copy sheet 56*a* or 56*a'* which is then fused thereto to form a color copy. This process is discussed in greater detail below.

With continued reference to FIG. 1, the printer or marking engine 18 is a xerographic printing device 8 comprising the photoreceptor belt 20 which is entrained about transfer rollers 24 and 26, a tensioning roller 28 and a drive roller 30. The drive roller 30 is rotated by a motor or other suitable mechanism coupled to the drive roller 30 by suitable means such as a belt drive 32. As the drive roller 30 rotates, it advances the photoreceptor belt 20 in a direction of arrow 22 to sequentially advance successive portions of the photoreceptor belt 20 through various processing stations disposed about the path of movement thereof.

The photoreceptor belt 20 is preferably made from a polychromatic photoconductive material comprising an anti-curl layer, a supporting substrate layer and an electrophotographic imaging single layer or multi-layers. The imaging layer may contained homogeneous, heterogeneous, inorganic or organic compositions. Preferably, finely divided particles of a photoconductive inorganic compound are dispersed in an electrically insulating organic resin binder. Typical photoconductive particles include metal-free phthalocyanine, such as copper phthalocyanine, quinacridones 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies and the like.

Initially, a portion of the photoreceptor belt 20 passes through an electrostatic charging station A. At electrostatic charging station A, a corona generating device 34 or other charging device generates a charge of voltage to charge the photoreceptor belt 20 to a relatively high, substantially uniform voltage potential. The corona generator device 34 comprises a corona generating electrode, a shield partially enclosing the electrode, and a grid that dispose between the photoreceptor belt 20 and an unenclosed portion of the electrode. The electrode charges the photoconductive surface of the photoreceptor belt 20 via corona discharge with an electrostatic charge. The voltage potential applied to the photoconductive surface of the photoreceptor belt 20 is varied by controlling the voltage potential of the wire grid.

Next, the charged photoconductive surface is rotated to an exposure station B. The exposure station B receives a modulated light beam corresponding to information derived by the RIS 10 having the multicolored original document 38 positioned thereon. The modulated light beam impinges on the surface of the photoreceptor belt 20, selectively illuminating the charged surface of the photoreceptor belt 20 to form an electrostatic latent image thereon. The photoconductive belt 20 is exposed three times to record three latent images representing each color.

After the electrostatic latent images have been recorded on the photoreceptor belt 20, the photoreceptor belt 20 is advanced towards a toner development station C. However, before reaching the toner development station C, the photoreceptor belt 20 passes subjacent to a voltage monitor, preferably an electrostatic voltmeter 33, for measurement of the voltage potential at the surface of the photoreceptor belt 20. The electrostatic voltmeter 33 can be any suitable type known in the art wherein the charge on the photoconductive surface of the photoreceptor belt 20 is sensed such as disclosed in U.S. Pat. Nos. 3,870,968; 4,205,257; or 4,853,639, the contents of which are incorporated by reference herein.

A typical electrostatic voltmeter is controlled by a switching arrangement which provides a measuring condition in which charge is induced on a probe electrode corresponding to the sensed voltage level of the photoreceptor belt 20. The induced charge is proportional to the sum of the internal capacitance of the probe and its associated circuitry. A DC measurement circuit is combined with the electrostatic voltmeter circuit for providing an output which can be read by a conventional test meter or input to a control circuit, as for example, the control circuit of the invention. The voltage potential measurement of the photoreceptor belt 20 is utilized to determine specific parameters for maintaining a predetermined potential on the photoreceptor surface, as will be understood with reference to the specific subject matter of the invention, explained in detail below.

The toner development station C includes four individual developer units indicated by reference numerals 40, 42, 44 and 46. The developer units 40, 42, 44 and 46 are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of development material into contact with the photoconductive surface.

The developer units 40, 42 and 44, respectively, apply toner particles of a specific color corresponding to the complement of the specific color separated electrostatic latent image recorded on the photoconductive surface. Each of the toner particles is adapted to absorb light within a preselected spectral region of the electromagnetic wave spectrum. For example, an electrostatic latent image formed by discharging the portions of charge on the photoreceptor belt 20 corresponding to the green regions of the original document will record the red and blue portions as areas of relatively high charge density on the photoreceptor belt 20, while the green areas will be reduced to a voltage level ineffective for development. The charged areas are then made visible by having the developer unit 40 apply green absorbing (magenta) toner particles onto the electrostatic latent image recorded on the photoreceptor belt 20. Similarly, a blue separation is developed by developer unit 42 with blue absorbing (yellow) toner particles while the red separation is developed by the developer unit 44 with red absorbing (cyan) toner particles. The developer unit 46 contains black toner particles and may be used to develop the electrostatic image formed from a black and white original document.

In FIG. 1, the developer unit 40 is shown in the operative position with the developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoreceptor belt 20, while in the non-operative position, the magnetic brush is spaced therefrom. Thus, each electrostatic latent image or panel is developed with toner particles of the appropriate color without commingling. Also, the toner development station C includes an optical sensor device 47 for sensing values of electrostatic charge formed on the photoreceptor 20 in a print control patch group.

Figure 2:
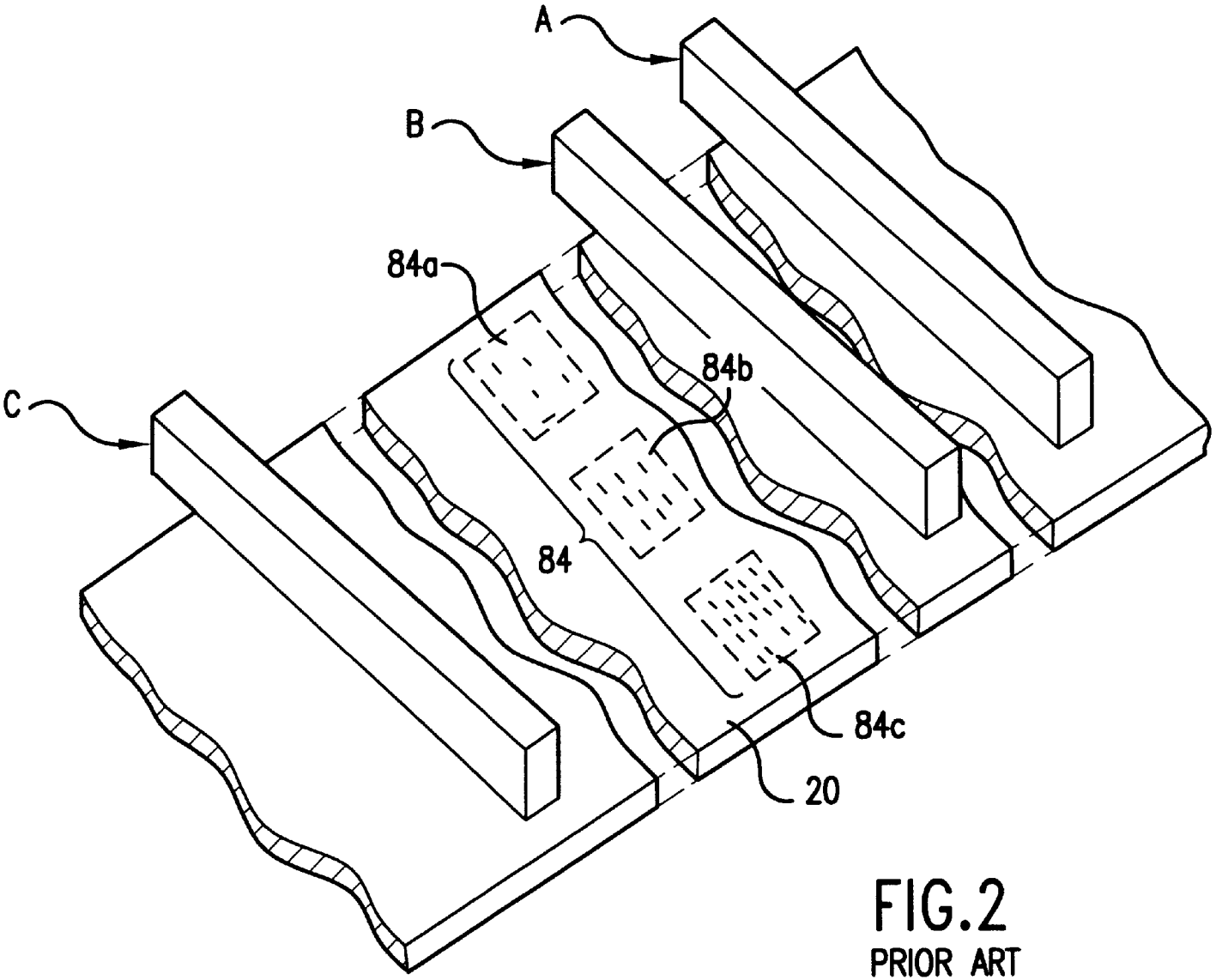
FIG. 2 PRIOR ART
FIG. 2 illustrates a conventional photoreceptor belt of the conventional xerographic printing device having low, medium and high density print control patches formed thereon.

One of ordinary skill in the art would comprehend that the electrostatic charging station A and the exposure station B are used to produce a print control patch group 84 as shown in FIG. 2. Although not by way of limitation, the print control patch group 84 includes three print control patches 84*a*, 84*b* and 84*c*. Subsequently, the toner development station C senses the values of the print control patches 84*a*, 84*b* and 84*c*, each of which has a different electrostatic density.

After development, the toner image is moved to a transfer station D. The transfer station D includes a transfer zone 64 defining the position at which the toner image is transferred to the copy sheet or print 56*a'*, which may be a sheet of plain paper or any other suitable support substrate. A sheet transport apparatus 48 moves the copy sheet 56*a'* into contact with the photoreceptor belt 20. The sheet transport 48 has a belt 54 entrained about a pair of substantially cylindrical rollers 50 and 52. A friction retard feeder 58 advances the uppermost sheet from a stack 56 of copy sheets onto a pre-transfer transport 60 for advancing the copy sheet to the sheet transport apparatus 48 in synchronism with the movement thereof so that a leading edge of the copy sheet arrives at a preselected position, i.e. a loading zone. The copy sheet is received by the sheet transport apparatus 48 for movement therewith in a recirculating path. As belt 54 of the sheet transport apparatus 48 moves in a direction of arrow 62, the sheet is moved into contact with the photoreceptor belt 20, in synchronism with the toner image developed thereon.

In the transfer zone 64, a corona generating device 66 sprays ions onto a backside of the copy sheet so as to charge the copy sheet to the proper magnitude and polarity for attracting the toner image from the photoreceptor belt 20 thereto. The copy sheet remains secured to a sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another to the sheet for forming the multi-color copy of the colored original document. One skilled in the art will appreciate that the sheet may move in a recirculating path for four cycles when undercolor black removal is used.

After the last transfer operation, the sheet transport apparatus 48 directs the sheet to a vacuum conveyor 68. The vacuum conveyor 68 transports the sheet in a direction of arrow 70 to a fusing station E where the transferred toner image is permanently fused to the sheet. The fusing station E includes a heated fuser roller 74 and a pressure roller 72. The sheet passes through a nip defined by the fuser roller 74 and the pressure roller 72. The toner image contacts the fuser roller 74 so as to be fixed to the sheet. Thereafter, the sheet is advanced by a pair of rolls 76 to a catch tray 78 for subsequent removal therefrom by the machine operator.

The last processing station in the direction of movement of the photoreceptor belt 20, as indicated by the arrow 22, is a cleaning station F. A lamp 80 illuminates the surface of the photoreceptor belt 20 to remove any residual charge remaining thereon. Thereafter, a rotatably mounted fibrous brush 82 is positioned in the cleaning station F and maintained in contact with the photoreceptor belt 20 to remove any residual toner particles remaining from the transfer operation prior to the start of the next successive imaging cycle.

Figure 3:
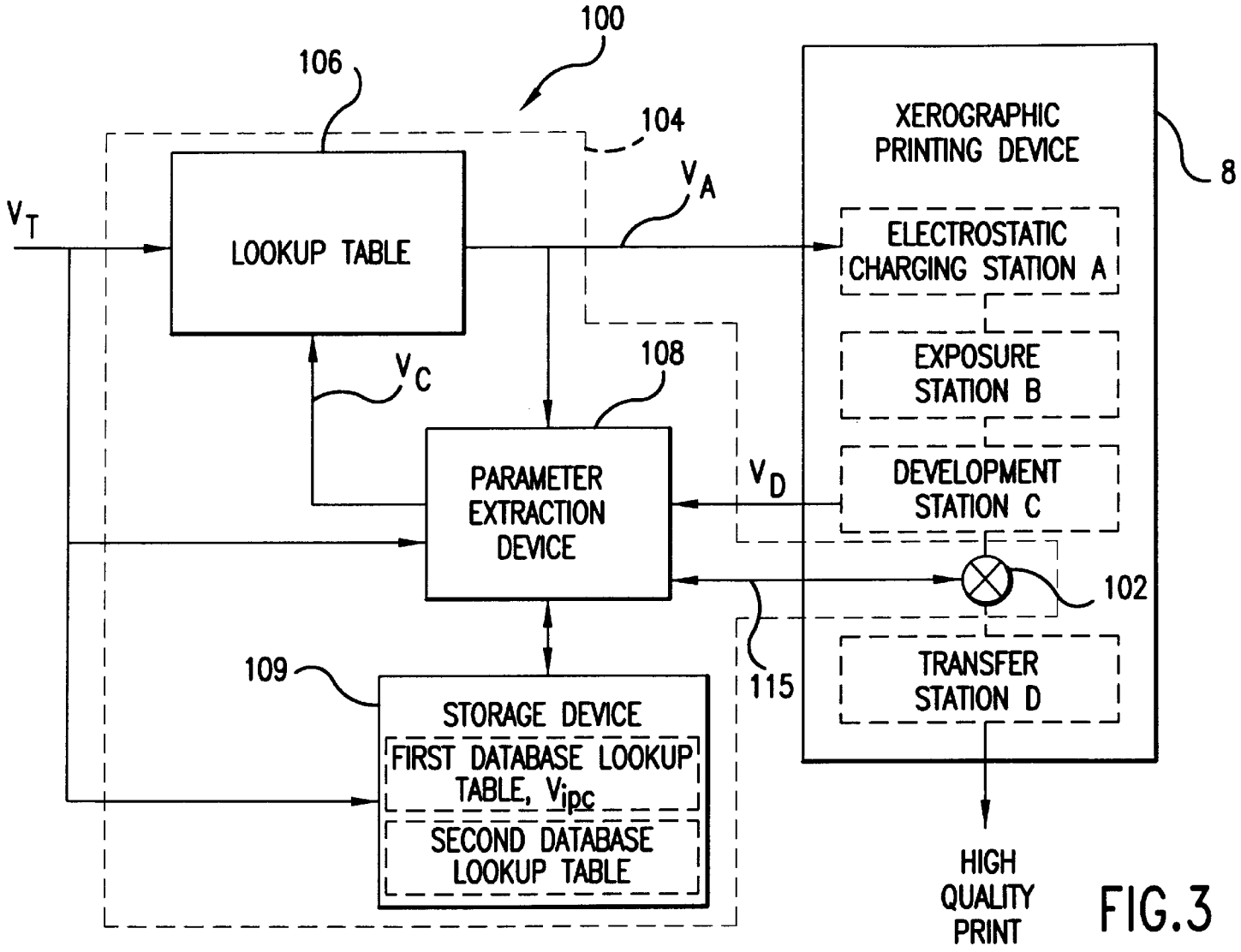
FIG. 3 is a first embodiment of the online printing parameter establishment apparatus of the invention operably connected to the xerographic printing device of FIG. 1.

An online printing parameter establishment apparatus 100 of the present invention is generally introduced in FIG. 3. The online printing parameter establishment apparatus 100 is used with the xerographic printing device 8 provided with a target value $V_T$ so that high quality prints can be printed. This is particularly useful when the xerographic printing device 8 changes print jobs and requires a new operating parameter regime. With the online printing parameter establishment apparatus 100 of the present invention, inferior quality prints no longer are required to be produced in order to permit the xerographic printing device 8 to adjust to the new operating parameter regime.

Furthermore, each type of xerographic printing device 8 has a plurality of sets of inherent performance characteristic values $V_{IPC}$ and includes different types of inherent performance characteristic values which are discussed further below that are inherent to a particular xerographic printing device. Also, the inherent performance characteristic values $V_{IPC}$ might also change with a model change of that particular type of xerographic printing device. The inherent performance characteristic values $V_{IPC}$ are determined empirically and are used to implement the online printing parameter establishment apparatus 100 of the present invention.

Also, the xerographic printing device 8 is capable of producing at least one print control patch on the photoreceptor 20 in order to sense a value $V_D$ (also referred to as sensed value or sensor value) of the at least one print control patch. A skilled artisan would appreciate that the at least one print control patch is the print control patch group 84 described above.

The online printing parameter establishment apparatus 100 of the invention includes a controller device 104 and a switch device 102. The controller device 104 produces a first database of different ones of sensed values $V_D$ and a second database of different ones of control values $V_{IPC}$. Each sensed value $V_D$ is associated with a respective one of the plurality of sets of inherent performance characteristic values. Each one of the control values $V_C$ is extracted from a respective one of the sensed values $V_D$ associated with its set of inherent performance characteristic values. Also, the controller device 104 selects one of the control values $V_C$. The selected control value $V_C$ which is comparable to the target value $V_T$ is used by the xerographic printing device 8 to print high quality prints.

The switch device 102 is operably connected to the controller device 104 through a line 115. The switch device 102 is operative to move between an establishment parameter state and a print production state. When the switch device 102 is in the establishment parameter state, the controller device 104 operates to produce the first and second databases and selects the one control value $V_C$ while the xerographic printing device 8 is incapable of printing prints. When the switch device 102 is in the print production state, the controller device 104 operates to provide the selected control value $V_C$ to the xerographic printing device 8 so that the xerographic printing device 8 can print high quality prints without printing inferior quality prints.

The controller device 104 includes a lookup table 106, a parameter extraction device 108 and a storage device 109. The lookup table 106 receives the target value $V_T$ and generates an actuator value $V_A$ that is based upon the selected control value $V_C$ received from the parameter extraction device 108. Also, the lookup table 106 stores the selected control value $V_C$ that is received from the parameter extraction device 108 for making customer prints continuously until it is reset by a new value.

The parameter extraction device 108 communicates with the lookup table 106 and the storage device 109. The parameter extraction device 108 is operative to iteratively receive each actuator value $V_A$ from the lookup table 106 and each sensed value $V_D$ and the inherent performance characteristic values $V_{IPC}$ from the storage device 109 in order to produce the first and second databases. The parameter extraction device 108 also can receive the target value $V_T$.

The storage device 109 is operative to store the inherent performance characteristic values $V_{IPC}$, the sensed values $V_D$ that are associated with respective ones of the plurality of sets of inherent performance characteristic values $V_{IPC}$ as well as the control values $V_C$ that are also associated with the respective one of the plurality of sets of the inherent performance characteristic values $V_{IPC}$. Although not by way of limitation, the storage device 109 contains the first database and the second database that are contained therein in a form of lookup tables and receives the target value $V_T$. However, algorithms might be used in lieu of lookup tables as is known to one of ordinary skill in the art. Preferably, the first database includes each sensed value $V_D$ and its associated set of inherent performance characteristic values $V_{IPC}$. The second database includes each control value $V_C$ and its associated set of inherent performance characteristic values.

Figure 4:
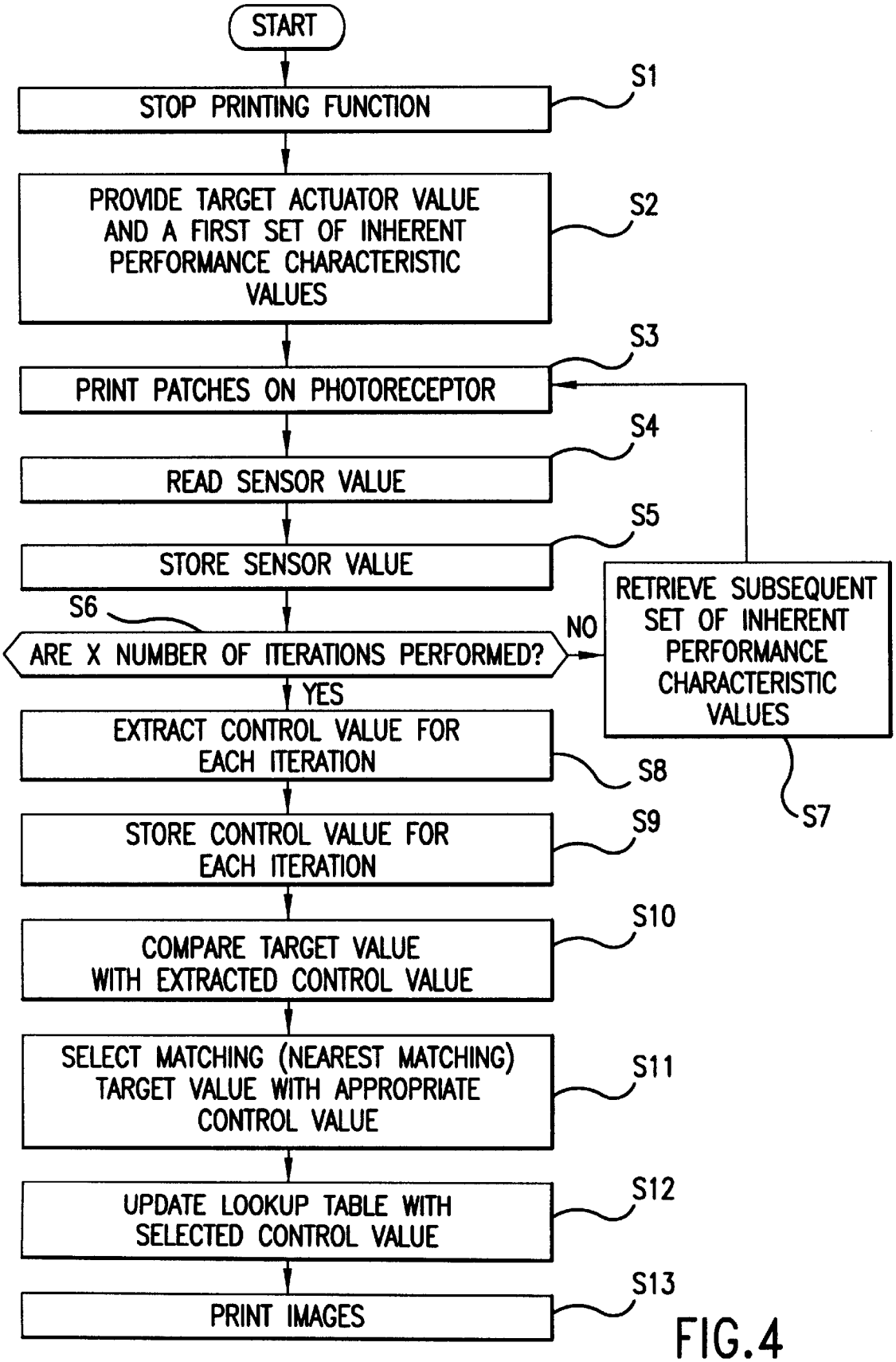
FIG. 4 is a flowchart illustrating steps for practicing the online printing parameter establishment apparatus of the invention of FIG. 3.

With reference to FIG. 4, a method for practicing the online printing parameter establishment apparatus 100 of the invention is described. Step S1 stops the normal printing function of the xerographic printing device 8. It is appreciated that stopping the printing function includes suspending operations of the transfer station D. Also, as described below, a control system of the xerographic print device used for normal printing operations can also be turned off.

Step S2 provides the target value $V_T$ and a first set of inherent performance characteristic values. One of ordinary skill in the art would appreciate that the target value $V_T$ can be a plurality of target values as opposed to a single target value.

Step S3 produces or prints either a print control patch or a print control patch group on the photoreceptor based upon the target value(s) $V_T$ and a selected set of inherent performance characteristic values $V_{IPC}$.

Step S4 reads the sensed value $V_D$ that is associated with the selected set of the inherent performance characteristic values. Again, a skilled artisan would appreciate that the sensed value $V_D$, the control value $V_C$ and the inherent performance characteristic values $V_{IPC}$ can each be either a singular value or multiple values as is required by the xerographic printing device 8. Step S5 stores the sensed value(s) $V_D$ that is associated with the selected set of the inherent performance characteristic values $V_{IPC}$. Step S6 determines whether a selected number of iterations of printing patches, and reading and storing sensor values are performed. If a selected number of iterations are not performed, the process proceeds to Step S7. Step S7 retrieves a subsequent set of inherent performance characteristic values $V_{IPC}$ and the process returns to Step S3 so that Steps S3, S4 and S5 can again be performed. In brief, Steps S3, S4 and S5 are repeated until each set of the plurality of sets of inherent performance characteristic values $V_{IPC}$ is associated with the sensed value $V_D$. Thus, the first database of sensed values $V_D$ and the inherent performance characteristic values $V_{IPC}$ is created.

Once the first database is created, a control value is extracted for each one of the plurality of sets of sensed value(s) $V_D$ and its associated inherent performance characteristic values as shown in Step S8. Use of the target value $V_T$ is made depending on the choice of algorithm while determining the inherent performance characteristic values $V_{IPC}$. In Step S8, extraction of the control value(s) $V_C$ may be required for intermediate segments of each equation. This can be done using appropriate multi-dimensional interpolation routines. In Step S9, the control value(s) $V_C$ which is associated with each set of a plurality of sets of inherent performance characteristic values and the associated sensed value is stored in Step S9. Step S10 compares the target value $V_T$ with the sensed values $V_D$ produced by all of the extracted control values $V_C$. The selected control value is considered the appropriate control value. In Step S11, the appropriate control value is selected by either matching it with the target value or selecting the nearest matching target value. In Step S12, the lookup table 106 is updated with the appropriate control value. Step S13 prints the images or prints in a high quality fashion without having to produce any inferior quality prints beforehand. In other words, the associated control value which is most closely associated with the target value is provided to the xerographic printing process so that high quality prints can be made using the associated control value.

For the first embodiment of the online printing parameter establishment apparatus 100 of the invention, the associated control value is an actuator value that is required by the xerographic printing device 8 to produce the desired printing results. This actuator value when used in the lookup table 106 produces the sensor values $V_D$ is either equal to or substantially equivalent to the target value. Also, the actuator value is calculated using a three-dimensional interpolation algorithm. In this case, the actuator value is a "hard" actuator value which can, therefore, be provided directly to the xerographic printing device 8.

Figure 5:
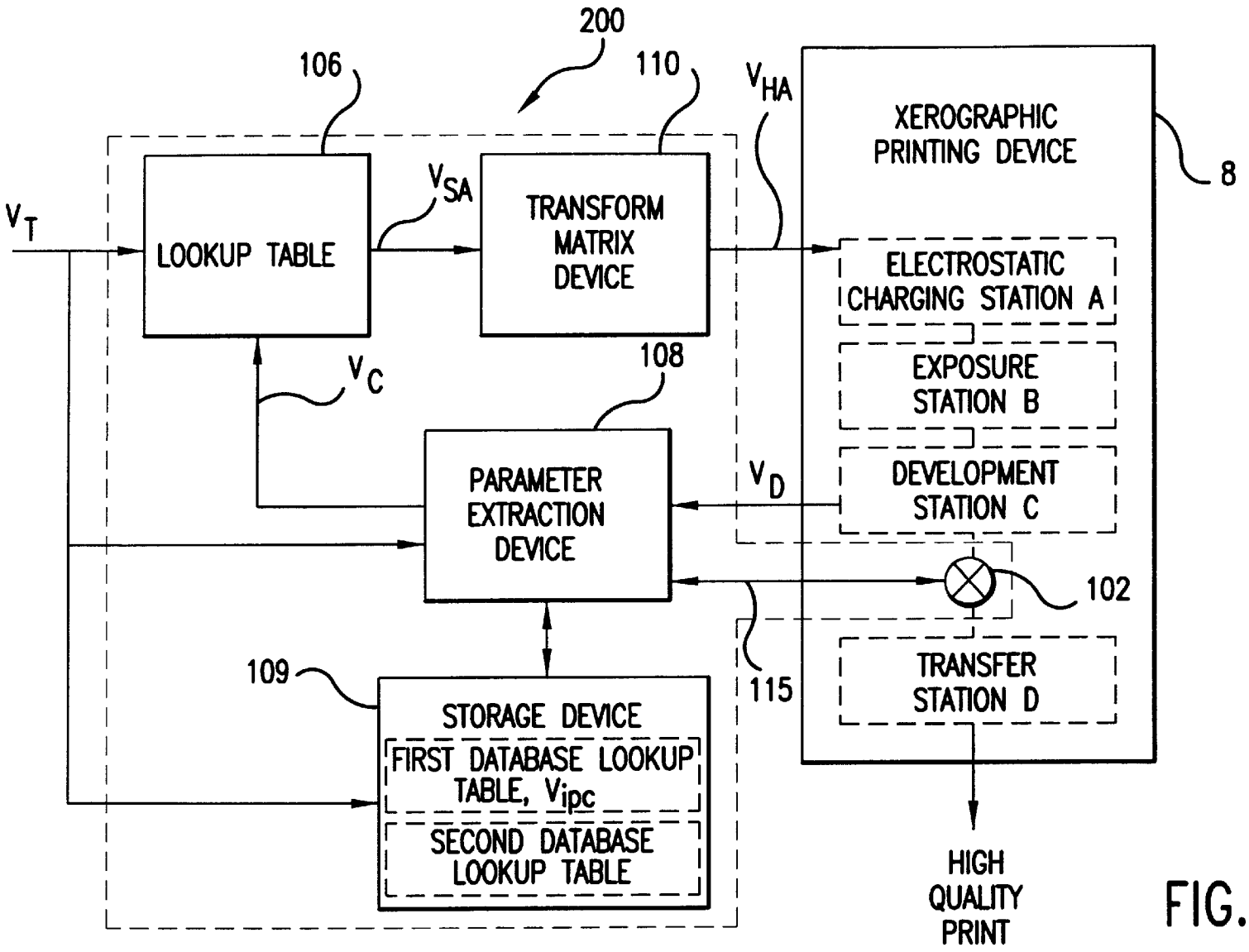
FIG. 5 is a second embodiment of the online printing parameter establishment apparatus of the invention operably connected to the xerographic printing device of FIG. 1.

A second embodiment of the online printing parameter establishment apparatus 200 is introduced in FIG. 5. The second embodiment of the online printing parameter establishment apparatus 200 includes the same components as the first embodiment of the online printing parameter establishment apparatus 100 described above. However, the controller device 104 includes a transform matrix device 110. The transform matrix device 110 transforms soft extracted actuator values $V_{SA}$ into hard extracted actuator values $V_{HA}$ which are provided to the xerographic printing device 8. A skilled artisan would appreciate that the lookup table 106 would contain at least one soft actuator value. A skilled artisan would also appreciate that soft actuator values are not usable by the xerographic printing device 8 and therefore must be transformed typically by a transform matrix algorithm into hard actuator values for use by the xerographic printing device 8.

Figure 6:
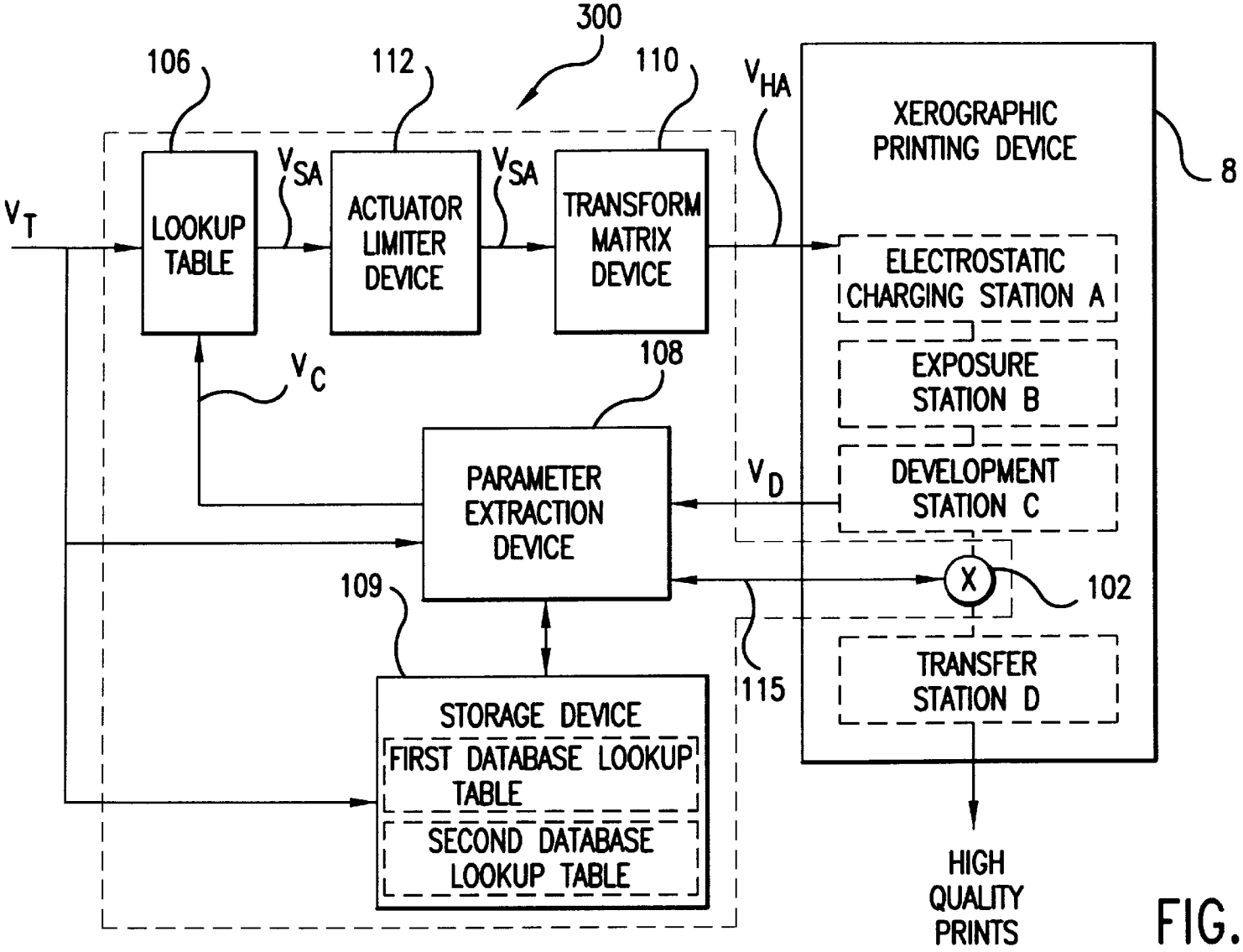
FIG. 6 is a third embodiment of the online printing parameter establishment apparatus of the invention operably connected to the xerographic printing device of FIG. 1.

A third embodiment of an online printing parameter establishment apparatus 300 is introduced in FIG. 6. The third embodiment of the online printing parameter establishment apparatus 300 of the invention includes the components of the second embodiment of the online printing parameter establishment apparatus 200 of the invention and also includes an actuator limiter device 112. The actuator limiter device 112 is serially connected in communication between the lookup table 106 and the xerographic printing device 8 for the third embodiment of the online printing parameter establishment apparatus 300 of the invention that is illustrated using soft actuator values $V_{SA}$. Particularly, the actuator limiter device 112 is serially connected between the lookup table 106 and the transform matrix device 110. The actuator limiter device 112 prevents any actuator values from exceeding a predetermined maximum actuator value or lagging a predetermined minimum actuator value determined by the manufacturer. Thus, regardless of the actuator value fed from the lookup table 106, the actuator value will not exceed the maximum actuator value nor will it lag a minimum actuator value.

Figure 7:
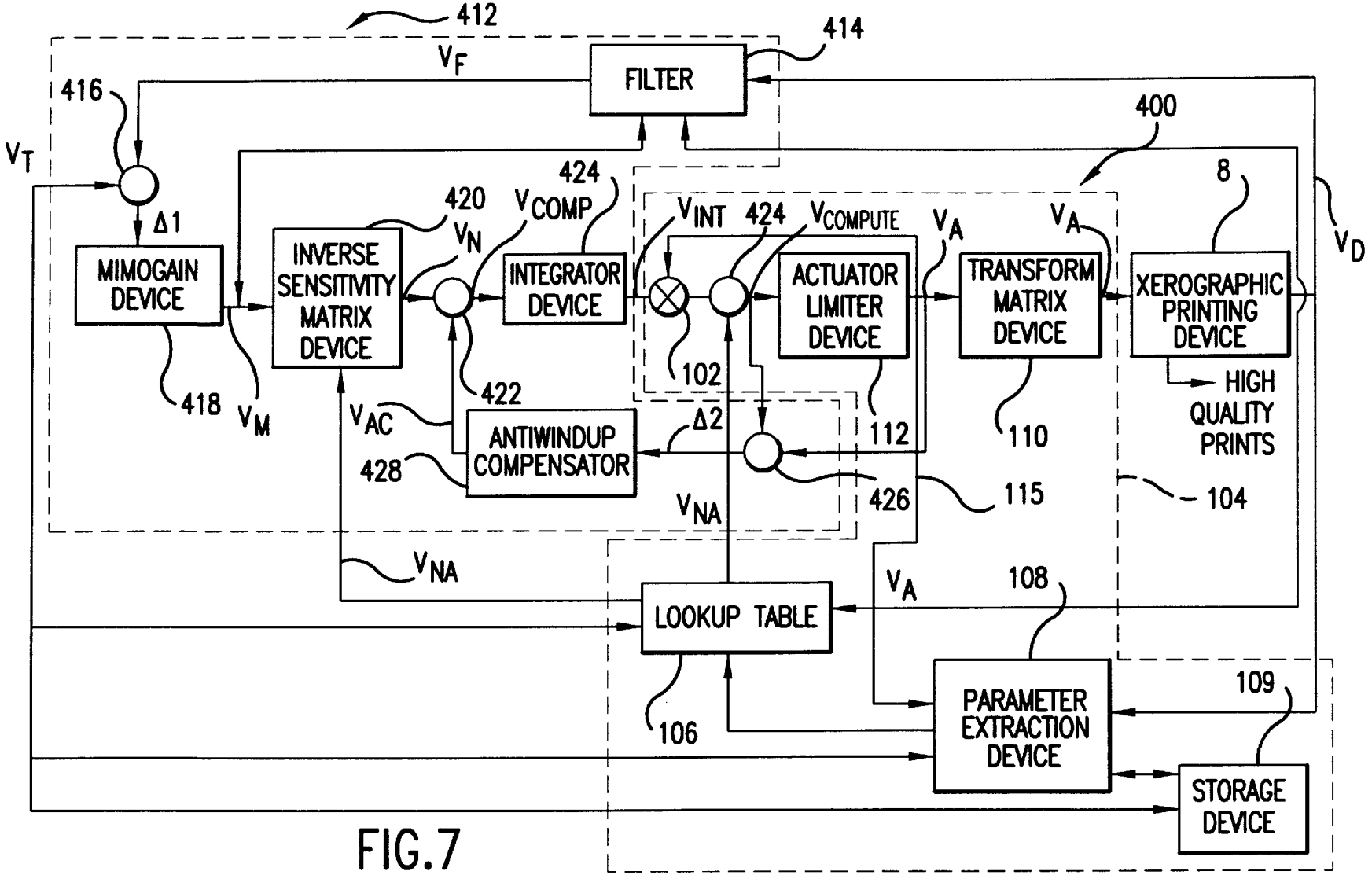
FIG. 7 is a fourth embodiment of the online printing parameter establishment apparatus of the invention serially connected with the xerographic printing device of FIG. 1 and a control system.

A fourth embodiment of the online printing parameter establishment apparatus 400 of the invention shown with a control system 412 of the xerographic printing device 8 is introduced in FIG. 7. The online printing parameter establishment apparatus 400 of the invention is used in conjunction with the transfer station D, described above, that transfers the electrostatic charge onto the copy sheet or print 56*a'* to produce the xerographic print 56*a,* and the control system 412. Although not by way of limitation and except as described below, the controller device 104 used for the fourth embodiment of the online printing parameter establishment apparatus 400 of the invention is the one described for the third embodiment of the online printing parameter establishment apparatus 300 of the invention.

With reference to FIG. 7, the control system 412 is explained. The sensed value $V_D$ is fed to both a filter 414 and the online printing parameter establishment apparatus 400 via the parameter extraction device 108. The second value $V_D$ is processed in the controller device 104 as described above. However, for the control system 412, the sensed value $V_D$ is processed through the filter 414 to produce a filtered sensed value $V_{FD}$ which is input to a first summing node 416. The target value $V_T$ is inputted to both the first summing node 416 and the lookup table 106. The first summing node 416 determines a difference $\Delta_1$ between the filtered sensed value $V_{FD}$ and the target value $V_T$. The first summing node difference $\Delta_1$ is inputted into a mimogain (MIMO) device 418, i.e., a multi-input multi-output device, and adjusted to produce a mimogain value $V_M$ which is filtered through the filter 414 and inputted into an inverse sensitivity matrix device 420. The inverse sensitivity matrix device 420 receives an updated nominal actuator value $V_{NA}$ from the lookup table 106 from time to time so that the inverse sensitivity matrix device 420 can also be updated. Typically, the inverse sensitivity matrix device 420 is updated when a new print job requires different print parameters. The inverse sensitivity matrix device 420 produces a normalized value $V_N$ based on the mimogain value $V_M$ which is input to a second summing node 422 that also receives an antiwindup compensator value $V_{AC}$ which is described in more detail below. The second summing node 422 yields a compensated value $V_{COMP}$ which is inputted into an integrator device 424. The integrator device 424 produces an integrated value $V_{INT}$ that is input to the online printing parameter establishment apparatus 400 of the invention.

If the switch device 102 is in the establishment parameter state, the integrated value $V_{INT}$ cannot be inputted into the online printing parameter establishment apparatus 400 of the invention, i.e. the integrated value $V_{INT}$ is zero. However, when the switch 102 is in the print production state, the integrated value $V_{INT}$ is provided to the online printing parameter establishment apparatus 400 of the invention. The integrated value $V_{INT}$ is inputted to a third summing node 424. The third summing node also receives the nominal actuator values $V_{NA}$ from the lookup table 106 to output a computed value $V_{COMPUTE}$ which is inputted to the actuator limiter device 112 and a fourth summing node 426. The actuator limiter device 112 determines whether the computed value $V_{COMPUTE}$ exceeds or lags the maximum or minimum values of a range of values as described above. The actuator limiter device 112 produces the actuator value $V_A$ which does not exceed the predetermined actuator value nor lag the predetermined minimum value.

The actuator value $V_A$ is inputted to the fourth summing node 426 and compared with the computed value $V_{COMPUTE}$. A difference $\Delta_2$, if any, is inputted to an antiwindup compensator device 428.

An example of how the online printing parameter establishment apparatus 400 of the invention shown in FIG. 7 operates as follows:

The switch device is moved from the print production state to the establishment parameter state. A skilled artisan would appreciate that the switch device can be moved manually or automatically in a manner known in the art. As shown in FIG. 7, the switch device 102 is electrically coupled to the controller device 104 through the parameter extraction device 108 by the line 115 which can provide automatic switching. A skilled artisan would appreciate that the online printing parameter establishment apparatus 400 of the invention can be used between print jobs when a different set of print parameters are required or can be used during a print job when a computer-controlled system such as the control system 412 determines that excessive drifting is occurring. However, an explanation of how to implement such a computer-controlled system is beyond the scope of the invention.

For the fourth embodiment of the online printing parameter establishment apparatus 400 of the invention, the lookup table 106 contains the inherent performance characteristic values as well as the actuator values. In other words, the control value includes both the inherent performance characteristic values as well as the actuator values in the form of the nominal actuator values $V_{NA}$.

Figure 8:
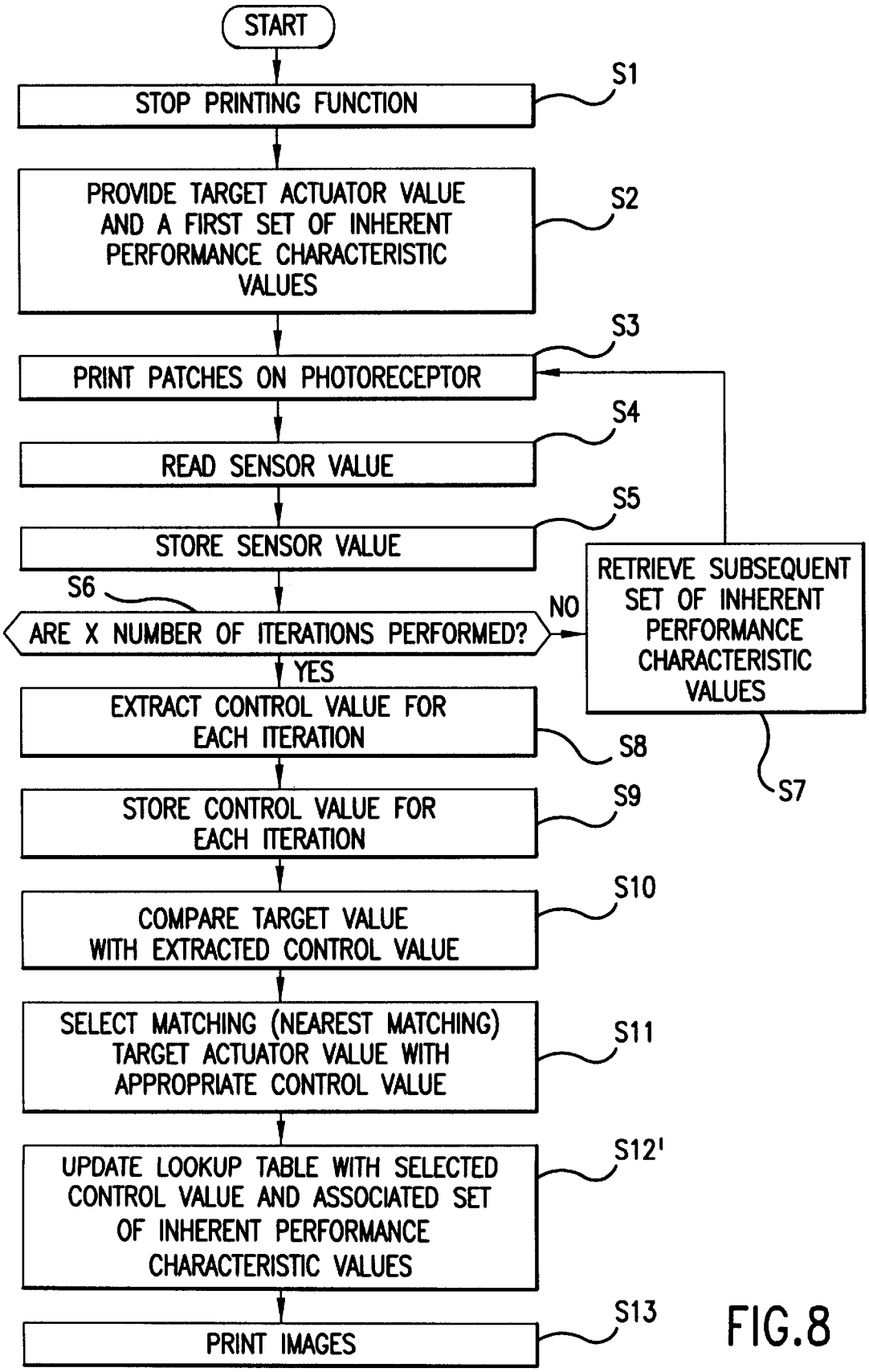
FIG. 8 is a flowchart illustrating steps for practicing the online printing parameter establishment apparatus of FIG. 7.

With reference to FIG. 8, practicing the fourth embodiment of the online printing parameter establishment apparatus of the invention is similar to the steps of FIG. 4. The only difference is step S12' which updates the lookup table with the selected control value as well as its associated set of inherent performance characteristic values.

By way of example and not by way of limitation, three inherent performance characteristic values such as discharge ratio DR, development voltage $V_{EM}$ and wire to donor AC voltage $V_{WDAC}$ are selected and nominal operating points are determined for a particular model of the xerographic printing device. For example, in one model of a xerographic printing device, the range of values for DR, $V_{EM}$ and $V_{WDAC}$ are listed in Table 1 as follows:

TABLE 1

| | DR | $V_{EM}$ | $V_{WDAC}$ |
|---|---|---|---|
| Minimum | 0 | 150 | 600 |
| Maximum | 0.16 | 400 | 850 |

Two sets of nominal values for each actuator is then selected and are listed in Table 2 as follows:

TABLE 2

| DR | $V_{EM}$ (volts) | $V_{WDAC}$ (volts) |
|---|---|---|
| 0.05 | 190 | 640 |
| 0.11 | 310 | 760 |

Thereafter, a series of the low, medium and high print control patches are developed on the photoreceptor by fixing the nominal values of two of the performance characteristics while varying a remaining value incrementally so that a graph of the results can be determined. For example, $V_{EM}$ and $V_{WDAC}$ are set at their first nominal values, i.e., 190 volts and 640 volts respectively, and the discharge ratio DR is varied incrementally in increments of 0.02 as illustrated in Table 3 below. Typically, the incremental steps are characteristic for a particular model of the xerographic printing device. The three print control patches are developed on the photoreceptor and toner development values are ascertained. This process is repeated for a second set of fixed nominal values. For example, the second set includes $V_{EM}$ is 190 volts and $V_{WDAC}$ is 760 volts with the discharge ratio DR again varying between the minimum and maximum values, i.e., 0.03 and 0.11 respectively, in increments of 0.02. This process is repeated until all combinations of the nominal values for the discharge ratio DR, the development voltage $V_{EM}$ and the wire to donor AC voltage $V_{WDAC}$ are completed. This continued process is illustrated in TABLE 3 below.

TABLE 3

| Set Number | DR | $V_{EM}$ | $V_{WDAC}$ |
|---|---|---|---|
| 1a | 0.03 | 190 | 640 |
| 1b | 0.05 | 190 | 640 |
| 1c | 0.07 | 190 | 640 |
| 1d | 0.09 | 190 | 640 |
| 1e | 0.11 | 190 | 640 |
| 2a | 0.03 | 190 | 760 |
| 2b | 0.05 | 190 | 760 |
| 2c | 0.07 | 190 | 760 |
| 2d | 0.09 | 190 | 760 |
| 2e | 0.11 | 190 | 760 |
| 3a | 0.03 | 310 | 640 |
| 3b | 0.05 | 310 | 640 |
| 3c | 0.07 | 310 | 640 |
| 3d | 0.09 | 310 | 640 |
| 3e | 0.11 | 310 | 640 |
| 4a | 0.03 | 310 | 760 |
| 4b | 0.05 | 310 | 760 |
| 4c | 0.07 | 310 | 760 |
| 4d | 0.09 | 310 | 760 |
| 4e | 0.11 | 310 | 760 |
| 5a | 0.03 | 190 | 640 |
| 5b | 0.03 | 220 | 640 |
| 5c | 0.03 | 250 | 640 |
| 5d | 0.03 | 280 | 640 |
| 5e | 0.03 | 310 | 640 |
| 6a | 0.03 | 190 | 760 |
| 6b | 0.03 | 220 | 760 |
| 6c | 0.03 | 250 | 760 |

TABLE 3-continued

| Set Number | DR | $V_{EM}$ | $V_{WDAC}$ |
|---|---|---|---|
| 6d | 0.03 | 280 | 760 |
| 6e | 0.03 | 310 | 760 |
| 7a | 0.11 | 190 | 640 |
| 7b | 0.11 | 220 | 640 |
| 7c | 0.11 | 250 | 640 |
| 7d | 0.11 | 280 | 640 |
| 7e | 0.11 | 310 | 640 |
| 8a | 0.11 | 190 | 760 |
| 8b | 0.11 | 220 | 760 |
| 8c | 0.11 | 250 | 760 |
| 8d | 0.11 | 280 | 760 |
| 8e | 0.11 | 310 | 760 |
| 9a | 0.03 | 190 | 640 |
| 9b | 0.03 | 190 | 670 |
| 9c | O.03 | 190 | 700 |
| 9d | 0.03 | 190 | 730 |
| 9e | 0.03 | 190 | 760 |
| 10a | 0.03 | 310 | 640 |
| 10b | 0.03 | 310 | 670 |
| 10c | 0.03 | 310 | 700 |
| 10d | 0.03 | 310 | 730 |
| 10e | 0.03 | 310 | 760 |
| 11a | 0.11 | 190 | 630 |
| 11b | 0.11 | 190 | 670 |
| 11c | 0.11 | 190 | 700 |
| 11d | 0.11 | 190 | 730 |
| 11e | 0.11 | 190 | 760 |
| 12a | 0.11 | 310 | 630 |
| 12b | 0.11 | 310 | 670 |
| 12c | 0.11 | 310 | 700 |
| 12d | 0.11 | 310 | 730 |
| 12e | 0.11 | 310 | 760 |

Five print control patch groups (three patches per group) are created for each set of DR, $V_{EM}$ or $V_{WDAC}$. Thus, a minimum of sixty print control patch groups would be required. A skilled artisan would also appreciate that, in this example, these sets of experiments are required for a single color. If the xerographic printing device is a multicolored device, an additional compilation of experiments would be required for each additional color.

Figure 9:
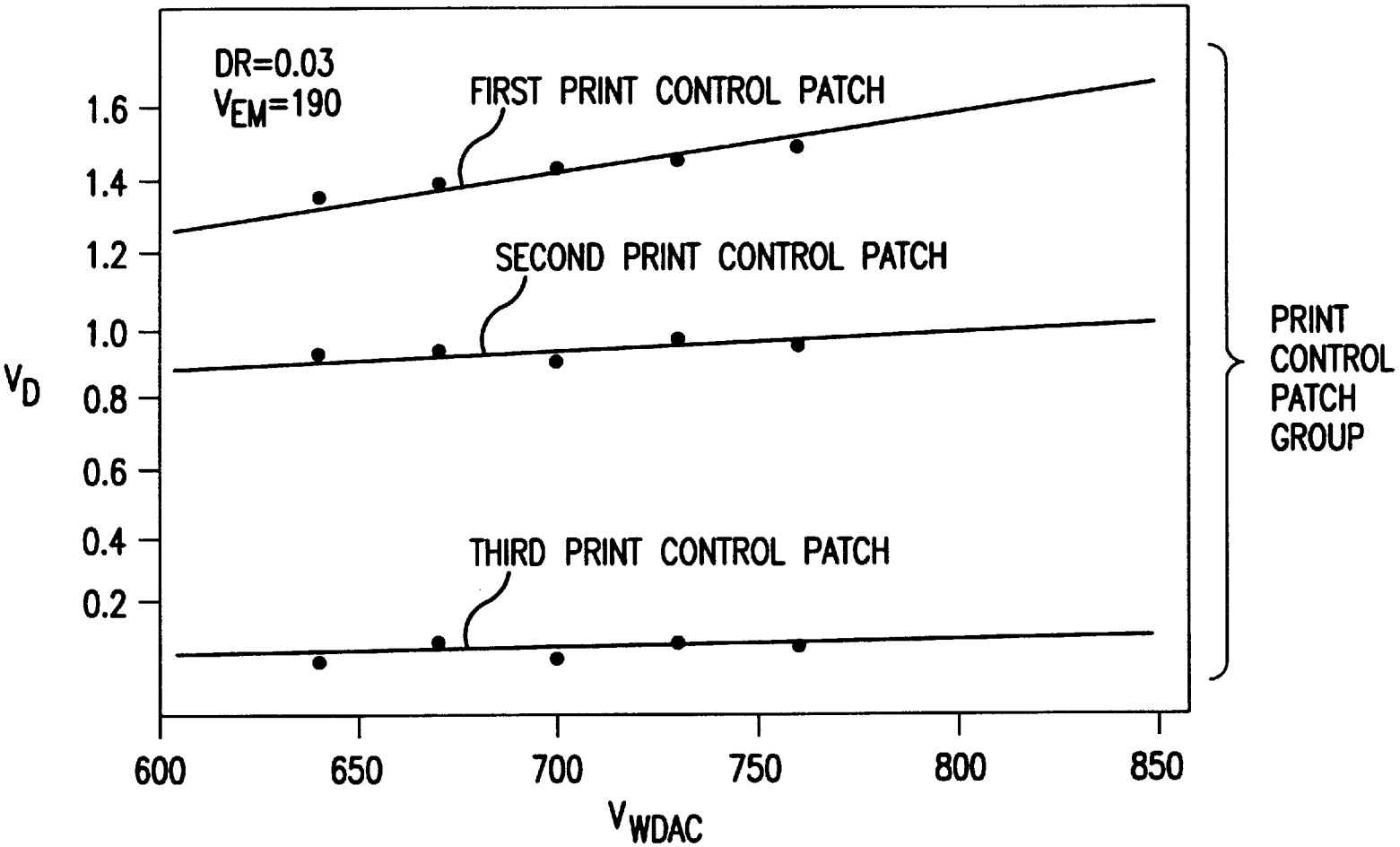
FIG. 9 is a graph including the inherent performance characteristic values representative of the xerographic printing device of FIG. 1.

By way of example, sets 9a–e in the above example is plotted in FIG. 9 wherein $V_D$ represents the sensed value $V_D$ of the optical sensor device.

A sensitivity matrix B is the slope of the lines labeled first, second and third print control patch and the lookup table 106 includes the data in Table 4 below:

TABLE 4

| $V_{Dhigh}$ | $V_{Dmid}$ | $V_{Dlow}$ | DR | $V_{EM}$ | $V_{WDAC}$ | B |
|---|---|---|---|---|---|---|

A skilled artisan would appreciate that the slope is obtained algorithmically from the experimental data. Furthermore, a conventional regression algorithm can be used to generate the B-matrix elements. For use by the inverse sensitivity matrix device 420 in FIG. 7, the inverse of B-matrix is computed by using conventional matrix inversion formulae.

Note that rather than calculating an actuator value, the above-example determines the B-matrix elements which are a component of the control values. These B-matrix elements along with the other control values are transmitted to the lookup table 106 which are used to determine the actuator value $V_A$ outputted from the lookup table 106.

The invention has been described with particularity in connection with the embodiments. However, it should be appreciated that changes may be made to the disclosed embodiments of the invention without departing from the spirit and inventive concepts contained herein.

What is claimed is:

1. A method for online establishment of print control parameters to print high quality prints using a xerographic printing process capable of producing a print control patch on a photoreceptor and sensing a value of the print control patch, the xerographic printing process having a plurality of sets of inherent performance characteristic values, the method comprising the steps of:

starting the xerographic printing process;

interrupting the xerographic printing process;

selecting a set of inherent performance characteristic values from the plurality of sets of inherent performance characteristic values;

providing a target value and the selected set of inherent performance characteristic values;

producing the print control patch on the photoreceptor based upon the target value and the selected set of inherent performance characteristic values;

sensing a value of the print control patch and associating the sensed value with the selected set of the inherent performance characteristic values;

reading and storing the sensed value associated with the selected set of the inherent performance characteristic values;

repeating the selecting, providing, producing, sensing, reading and storing steps by selecting another one of the plurality of sets of inherent performance characteristic values until each set of the plurality of sets of inherent performance characteristic values is associated with a stored sensed value;

extracting a control value for each stored sensed value and the associated set of inherent performance characteristic values storing the control value associated with each stored sensed value and the associated set of inherent performance characteristic values;

providing the control value that is most closely associated with the target value to the xerographic printing process; and resuming the xerographic printing process to print high quality prints using the associated control value.

2. A method according to claim 1, wherein the associated control value is at least one of an actuator value and a B matrix element.

3. A method according to claim 2, wherein the actuator value is used to produce the sensed value and the sensed value is at least substantially equivalent to the target value.

4. A method according to claim 1, wherein the step of extracting the control value includes calculating the at least one control value.

5. A method according to claim 4, wherein the control value is calculated using a multi-dimensional interpolation algorithm.

6. A method according to claim 1, wherein the inherent performance characteristic values are one of soft performance characteristic values and hard performance characteristic values.

7. A method according to claim 1, wherein the step of providing the control value includes comparing the target value with the sensed value associated with the control value for each set of inherent performance characteristic values.

8. A method according to claim 7, wherein the step of providing the control value includes selecting a nearest matching sensed value, associated with the control value, by comparison with the target value.

9. A method according to claim 8, wherein the step of providing the control value includes updating a lookup table with the associated set of inherent performance characteristic values.

10. A method according to claim 1, wherein the step of providing the control value includes providing the inherent performance characteristic values.

11. An online printing parameter establishment apparatus for use with a xerographic printing device for printing high quality prints based upon a target value, the xerographic printing device capable of producing a print control patch on a photoreceptor and sensing a value of the print control patch, the xerographic printing device having a plurality of sets of inherent performance characteristic values, the online printing parameter establishment apparatus comprising:

a controller device operative to produce a first database of different values sensed by the xerographic printing device with each sensed value associated with a respective one of the plurality of sets of inherent performance characteristic values based upon the target value, to produce a second database of different control values with each of the control values extracted from a respective one of the sensed values and the associated set of inherent performance characteristic values and to select one of the control values, the selected control value being comparable to the target value; and a switch device operably connected to the controller device and operative to move between an establishment parameter state and a print production state wherein, when the switch device is in the establishment parameter state, the controller device is operative to produce the first and second databases and to select the one control value with the associated set of inherent performance characteristic values while the xerographic printing device is incapable of printing prints and, when the switch device is in the print production state, the controller device is operative to provide the one control value to the xerographic printing device so that the xerographic printing device can print high quality prints without printing inferior quality prints.

12. An online printing parameter establishment apparatus according to claim 11, wherein the controller device includes a lookup table, a parameter extraction device and a storage device, the lookup table operative to receive the target value, to generate an actuator value based upon each set of inherent performance characteristic values received from the parameter extraction device and to store the selected control value and the associated set of inherent performance characteristic values received from the parameter extraction device, the parameter extraction device in communication with the lookup table and the storage device and operative to receive each actuator value from the lookup table, each sensed value and the inherent performance characteristic values from the storage device in order to produce the first and second databases and the storage device operative to store the inherent performance characteristic values, the sensed values associated therewith and the control values associated therewith.

13. An online printing parameter establishment apparatus according to claim 12, further comprising a transform matrix device for transforming soft actuator values into hard actuator values, the transform matrix device operative to provide the xerographic printing device with the hard actuator values.

14. An online printing parameter establishment apparatus according to claim 12, further comprising an actuator limiter device serially connected in communication between the lookup table and the xerographic printing device and operative to prevent each actuator value from one of exceeding a predetermined maximum actuator value and lagging a predetermined minimum actuator value.

15. An online printing parameter establishment apparatus according to claim 11, wherein the first database and the second database are contained in a storage device.

16. An online printing parameter establishment apparatus according to claim 15, wherein each one of the first and second databases is a lookup table.

17. An online printing parameter establishment apparatus according to claim 16, wherein the first database includes each sensed value and the associated inherent performance characteristic values.

18. An online printing parameter establishment apparatus according to claim 17, wherein the second database includes each control value and the associated inherent performance characteristic values.

19. An online printing parameter establishment apparatus according to claim 11, wherein the controller device provides a most current appropriate set of inherent performance characteristic values that are associated with the selected control value.

20. A method for producing an image using an output device, comprising:

providing at least one target value and at least one outut device performance characteristic;

producing at leat one control patch based upon the at least one target value and the at least one output device performance characteristic;

detecting, from the at least one control patch, at least one value associated with the at least one output device performance characteristic;

extracting at least one control value from the at least one detected vallue and the associated at least one output device performance characteristic; and producing the image based on the at least one control value.

21. The method according to claim 20, wherein the at least one control value is at leaston one of an actuator value and a B matrix element.

22. The method according to claim 20, wherein the at least one detected value is at least substantially equivalent to the at least one target value.

23. The method according to claim 20, wherein the at least one control value is extracted using a multi-dimensional interpolation algorithm.

24. The method according to claim 20, wherein the at least one output device performance characteristic is one of a soft performance characteristic and a hard performance characteristic.

25. The method according to claim 20, further comprising:

storing the at least one detected value associated with the at least one output device performance characteristic;

repeating the providing, producing, detecting, and extracting steps using at least one second output device performance characteristic to obtain at least one second control value; and providing at least one output control value to the output device, the at least one output control value being chosen from the at least one control value and the at least one second control value that is most closely associated with the at least one target value, wherein the image is produced based on the at least one output control value.

26. The method according to claim 25, wherein providing the at least one output control value includes comparing the at least one target value with the at least one detected value associated with the at least one output device performance characteristic and the least one second detected value associated with the at least one second output device performance characteristic.

27. The method according to claim 25, wherein the step of providing the at least one output control value includes selecting a detected value associated with the at least one control value or the at least one second control value that most nearly matched the at least one target value.

28. An output device for outputting an image, comprising:

a controller, wherein the controller receives a target value for outputting the image;

a first database of control patch values, each control patch value being associated with a respective one of a plurality of sets of output device performance characteristic values;

a second database of control values, each one of the control values extracted from a respecitve one of the control patch values and the associated set of output device performance characteristic values; and an output part, wherein the controller selects at least one of the control values from the second database based on a comparison of the control values with the target value, and wherein the output part outputs the image based on the selected at least one control value.

29. An image output device, comprising:

a controller;

a sensor; and an output part, wherein the controller instructs the output part to output a control patch based upon at least one target value and at least one output device performance characteristic, the sensor senses, from the control patch, at least one sensed value, the controller extracts at least one control value from the at least one sensed value and the at least one output device performance characteristic, and wherein the output part produces an image based on the at least one control value.

30. The image output device according to claim 29, wherein the at least one control value is at least one of an actuator value and a B matrix element.

31. The image output device according to claim 29, wherein the at least one control value is extracted using a multi-dimensional interpolation algorithm.

32. The image output device according to claim 29, wherein the at least one output device performance characteristic is one of a soft performance characteristic and a hard performance characteristic.

33. The image output device according to claim 29, further comprising:

a storage device that stores the at least one sensed value associated with the at least one output device performance characteristic, wherein the controller instructs the output part to output a second control patch based upon at least one target value and at least one second output device performance characteristic, the sensor senses, from the second control patch, at least one second sensed value, and the controller extracts at least one second control value from the at least one second sensed value and the associated at least one second output device performance characteristic, and wherein the controller provides at least one output control value to the output part, the at least one output control value being chosen from the at least one control value and the at least one second control value that is most closely associated with the at least one target value, wherein an image is produced based on the at least one output control value.

34. The image output device according to claim 33, wherein the controller compares at least one target value with the sensed values associated withe the at least one output device performance characteristic and the at least one second output device performance characteristic and provides the at least one output control value based on results of the comparison.

35. The image output device according to claim 33, wherein the controller selects a sensed value associated with the at least one control value or the at least one second control value that most nearly matches the at least one target value and provides the at least one output control value based on the selected sensed value.

* * * * *